US005971897A

United States Patent [19]

Olson et al.

[11] Patent Number: 5,971,897

[45] Date of Patent: Oct. 26, 1999

[54] MULTI-PURPOSE, NATURAL-MOTION EXERCISE MACHINE

[76] Inventors: Jeffrey Lawrence Olson; Rorik Theron Olson, both of 504 Main St., Winters, Calif. 95694

[21] Appl. No.: 09/201,212

[22] Filed: Nov. 30, 1998

[51] Int. Cl.[6] ..... A63B 21/06; A63B 21/078

[52] U.S. Cl. ..... 482/101; 482/94

[58] Field of Search ..... 402/94, 101, 98, 402/104, 108, 135

[56] References Cited

U.S. PATENT DOCUMENTS

| | | | |
|---|---|---|---|
| 3,647,209 | 3/1972 | Lahanne . | |
| 4,010,947 | 3/1977 | Lambert, Sr. . | |
| 5,152,731 | 10/1992 | Troutman | 482/106 |
| 5,314,394 | 5/1994 | Ronan | 482/104 |
| 5,669,859 | 9/1997 | Liggett et al. | 482/94 |
| 5,823,921 | 10/1998 | Dawson | 482/104 |

*Primary Examiner*—John Mulcahy

[57] ABSTRACT

An exercise machine having at least one vertical guide column with centrally located holes mounted on a base, two sleeves with attached bearings, a set of handlebars, and a spring-loaded locking device. One bearing sleeve slides on the vertical guide column, the other slides horizontally on a receiver shaft attached to the sleeve traveling vertically on the guide column. Thus the two bearing sleeves are attached in perpendicular relationship. Bars for securing standard weight-plates are attached to the bearing sleeve which travels on vertical guide column. Handlebars and spring-loaded locking device are attached to the sleeve sliding horizontally on receiver shaft, permitting withdrawal of a spring-loaded locking rod from aforementioned centrally located holes in vertical guide column, as well as horizontal positioning of handlebars during lift and replacement of spring-loaded locking rod into centrally located holes at completion of lift.

9 Claims, 10 Drawing Sheets

MULTI-PURPOSE, NATURAL-MOTION EXERCISE MACHINE

BACKGROUND

1. Field of Invention

The present invention relates to the field of exercise machines and devices, more specifically an improved method of permitting safe, free-ranging motion in a given exercise.

2. Background Art

All machines we've observed either limit the user to straight up and down motion, or along a fixed arc. In addition, exercise machines generally limit both start-up and finish positions in a given movement. For most machines, the start-up position is also the finish position. This reduces the amount of weight that can be lifted, since in most lifts that start-up position is also the weakest portion of the lift.

Those machines that permit flexibility in start and finish positions (for example, Smith Machine) have a tendency to bind under load, and do not permit natural elliptical motion.

Free-weight lifting eliminates many of these problems, yet lacks the controlled safety and balance of machines.

We believe we've devised a machine that combines the best of both free-weights and machines, permitting a much larger degree of natural motion in a given lift, as well as a variable start-up and finish position, while incoroporating the saftey and control of a machine.

Specifically, our machine permits: 1) simultaneous horizontal and vertical movement of the weight in any given lift (no fixed straight up and down or arc to motion); 2) the ability to lock weight in any position throughout the exercise; 3) the ability to initiate the lift from any position throughout the range of the machine, with ensuing full range of motion; 4) superior ease of movement versus other machines; 5) the use of standard weights (eliminating expense of creating specialized weights); 6) infinite adjustment of gripping apparatus within a given range to suit user arm length; 7) main sliding unit is easily detachable for multitude of additional exercise applications; 8) simple assembly and diassembly (everything comes apart, and the preferred embodiments of this invention employ few or no bolts, etc., in general assembly).

The first four of the features listed above are made possible by our invention's most essential component, which we call the Bearing Sleeve. In its preferred embodiment, the Bearing Sleeve consists of a section of square tubing with ring bearings attached. The bearing sleeve slides over a shaft of square tubing of sufficiently small diameter to fit within it.

These bearing sleeves can accept any number of attachments, including weight-lifting Handlebars, additional receivers, etc. By combining two bearing sleeves, one sliding on a vertical shaft—the other on a horizontal shaft attached to the vertically sliding sleeve—simultaneous horizontal and vertical motion can be achieved.

This two-way motion is crucial to achieve many of the invention's "special effects," including locking and disengaging weight-lifting Handlebars from any position (while retaining full normal range of lift), and the capability of following the body's natural motion rather than a fixed line of motion.

Thus, our machine adjusts to the body, rather than forcing the body to adjust to the machine.

Some brief comparisons of closest known art (listed along with others in attached Information Disclosure Statement):

The VARIABLE WEIGHT EXERCISE MACHINE by Lambert, patent #4010947, employs a bearing-mounted carriage attached to weight stack and weight bearing bars. This device does slide up and down on bearings, but does not permit free, elliptical range of motion; nor does it permit complete control of beginning and end of motion. It is also vastly more complex in operation and parts (for example, it requires specially designed guides, carriage, weight stack, etc., whereas our invention uses generic weight plates and simple square tubing sections).

In BARBELL HAVING AXIALLY MOVING GRIP, #5152731, Troutman shows a pair of sliding cylinders on a barbell. These cylinders employ some form of bearings. The barbell, however, must be specially modified with channels to acommodate the sliding cylinders (no special runners are required for our bearing sleeve). As a free weight device, no methods exist for locking weight-bearing bar during lift, or for maintaining proper balance (a small imbalance during the lift would result in barbell shifting dangerously).

Jack LaLanne shows in WEIGHT LIFTING TYPE EXERCISING DEVICE, #3647209, a cable-based system that claims capacity to lock weights in different positions throughout a lift. His device requires specialized weights, and lacks natural-motion and disengagement capabilities. Most bodybuilders believe that cable systems in general lack the feel and stimulus of lifting weight directly.

SUMMARY

The Multi-Purpose, Natural-Motion Exercise Machine is a simple but highly versatile device which permits a multitude of weight-lifting operations, featuring a non-fixed arc of motion, locking of weight at any point during lift, and initiation of lift from any point while permitting a subsequent full range of up and down motion.

DESCRIPTION OF INVENTION

Figure 1:
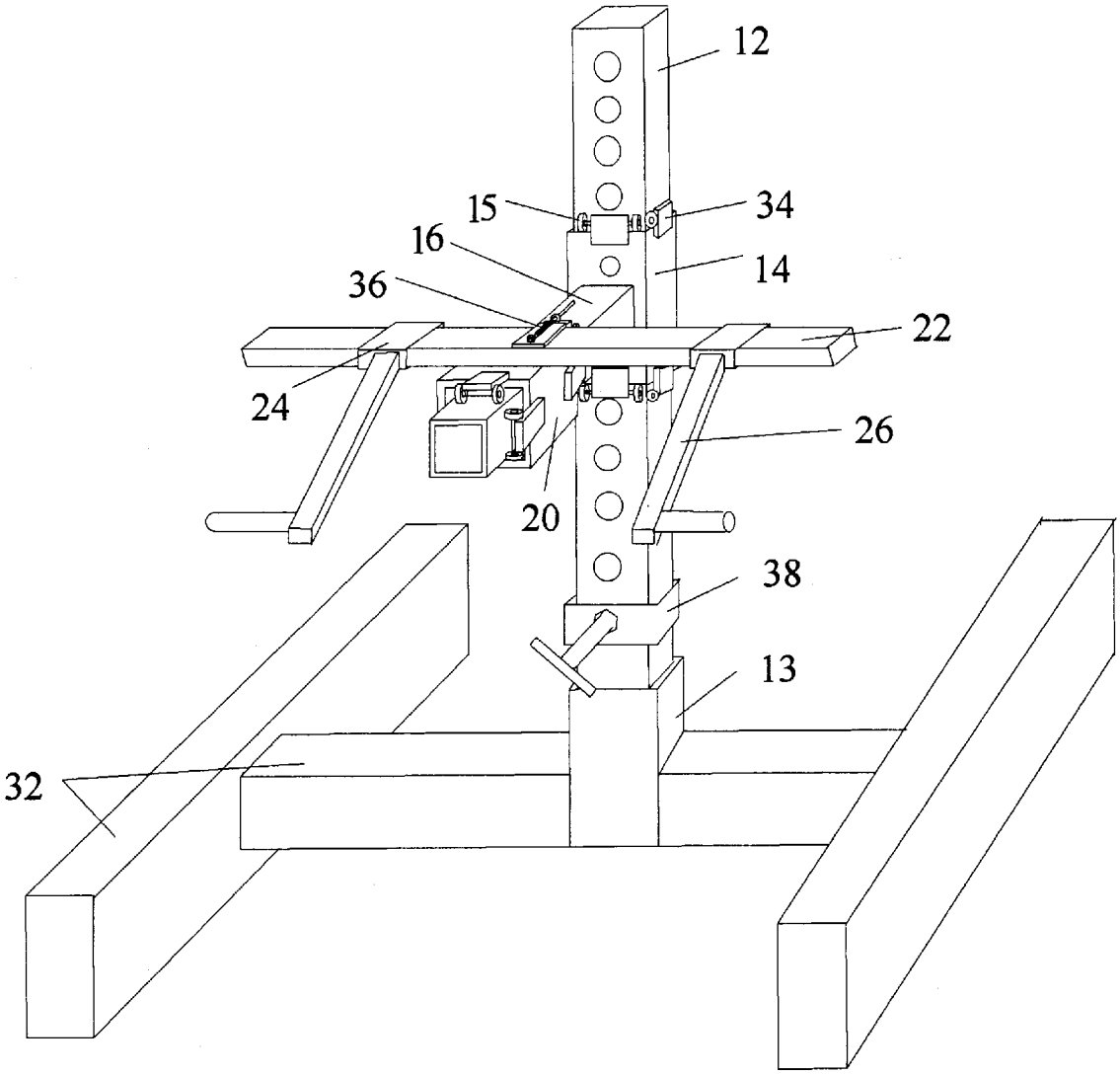
FIG. 1 is a perspective depiction of the machine, seen from the front.

FIG. 1 shows a perspective, front view of our machine. Included in this figure are:

12) Main Shaft

An upright shaft of square tubing, with holes drilled into it at periodic intervals.

14) Main Bearing Sleeve

A section of square tubing with bearings attached. It fits on Main Shaft. Its bearings (15) make contact with Main Shaft. A steel rod is inserted through bearings and attached (generally welded) to steel flanges projecting out from surface of Main Bearing Sleeve.

15) Bearings

Preferred sliding means for bearing sleeves.

16) Main Bearing Sleeve Shaft

This is another length of square tubing, which is attached to the front face of the Main Bearing Sleeve.

20) Handlebars Bearing Sleeve

Another length of tubular steel with attached bearings. This slides on Main Bearing Sleeve Shaft.

22) Handlebars Support Shaft

Length of square tubing attached perpendicularly to top of Handlebars Bearing Sleeve.

24) Support Shaft Sleeves

Short sections of square tubing that fit on Handlebars Support Shaft, to which Handlebars are attached.

26) Handlebars

Heavy steel or pipe bars attached to Support Shaft Sleeves.

32) Support Stand

I-shaped assembly of square tubing steel.

34) Bearing Flanges

Metal tabs that bearings are attached to.

36) Spring-Loaded Catch

Attached to top of Handlebars Support Shaft. Consists of Lock Rod Sleeves (36A), Lock Rod Spring (36B), and Lock Rod (36C). Spring is attached to steel rod, and braced between rod sleeves. Steel rod goes through drilled hole in Main Bearing Sleeve into hole drilled into Main Shaft.

38) Safety Catch

A short section of square tubing with pipe and attached rod that fits on Main Shaft. Consists of Safety Catch Handle (38A), Safety Catch Lock Rod (38B), Safety Catch Securing Nut (38D), and Safety Catch Sleeve (38E).

Figure 2:
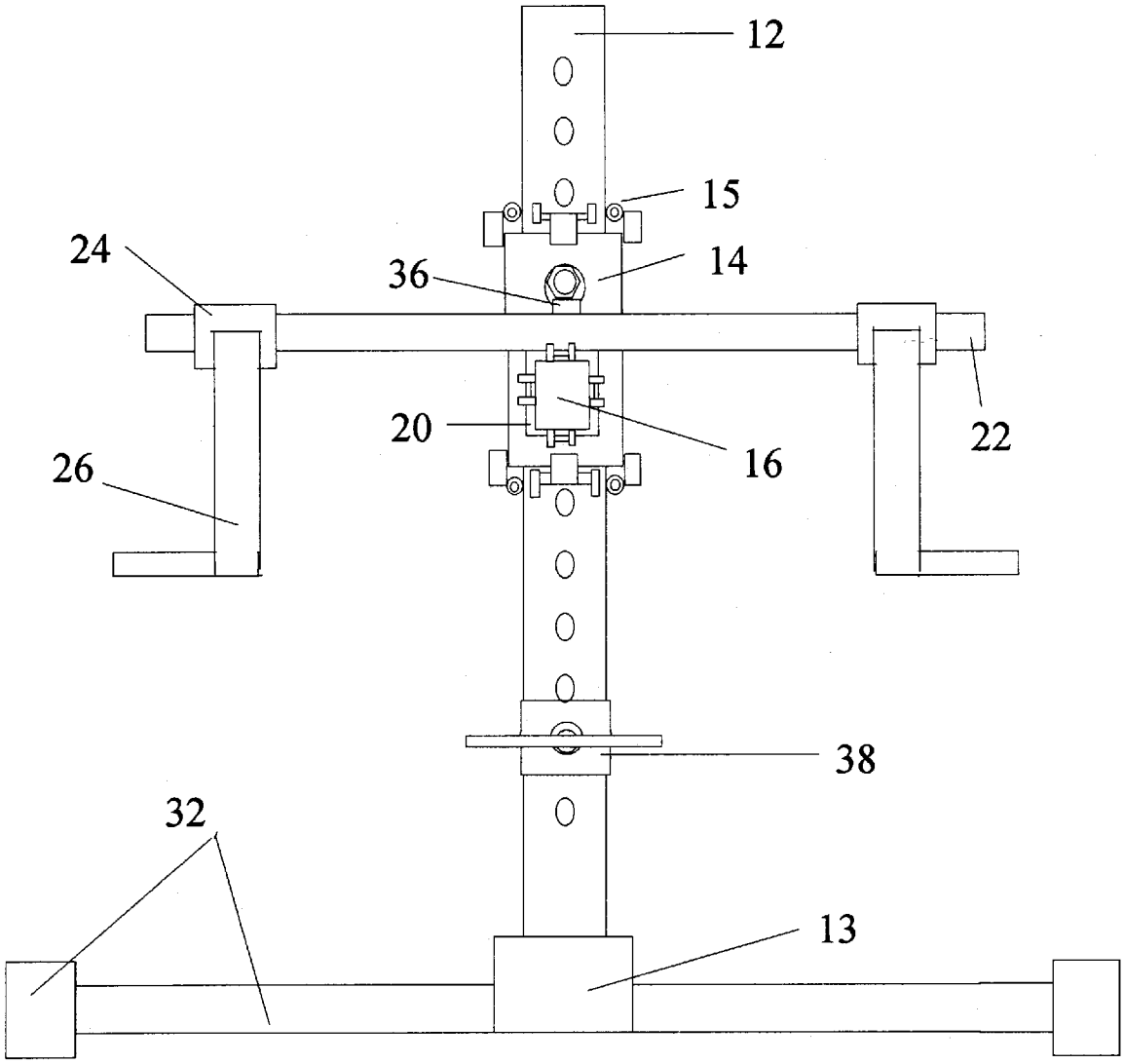
FIG. 2 is an orthogonal view of the front of the machine.

FIG. 2 shows the invention in front orthogonal view, same principle parts listed.

Figure 3:
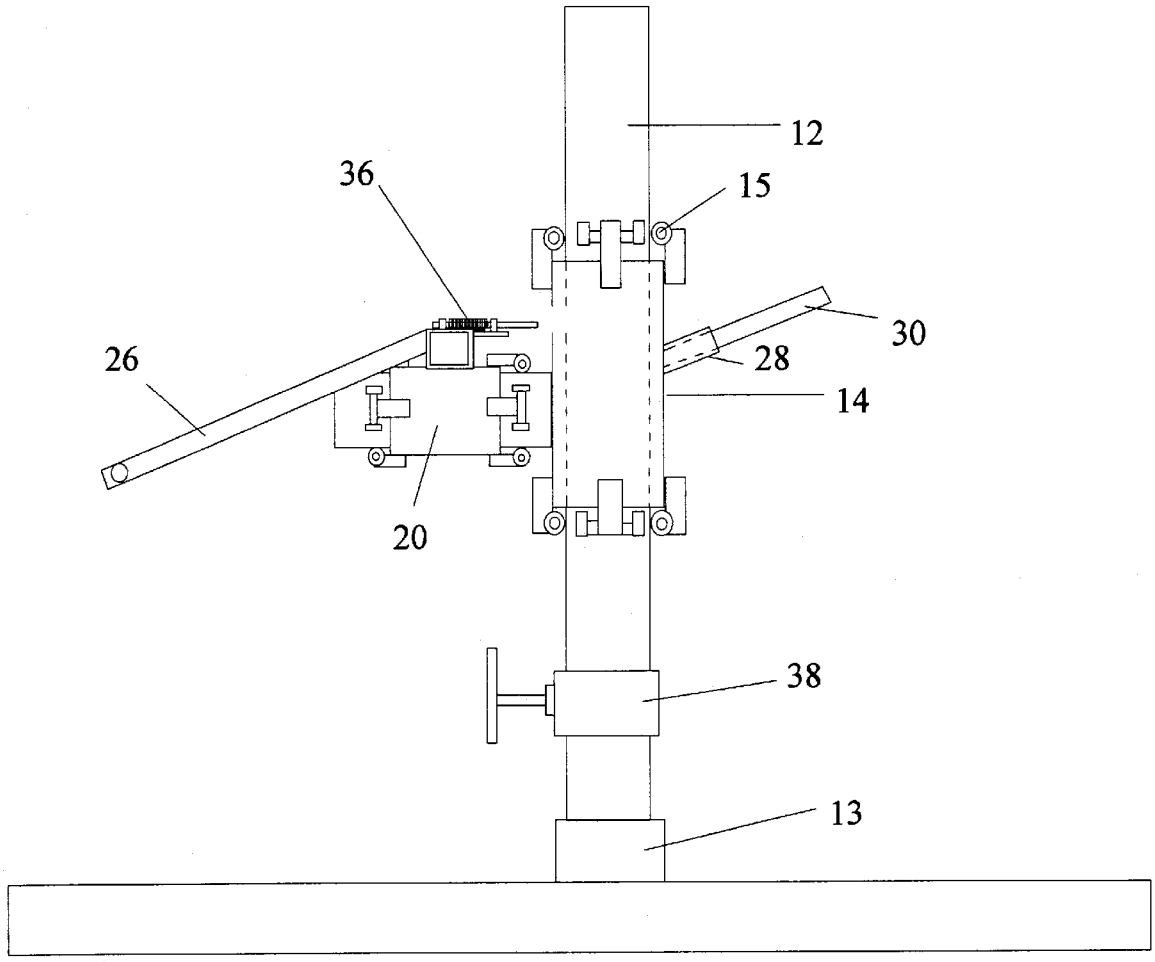
FIG. 3 is an othogonal view of the side of the machine.

FIG. 3 shows the invention in side orthogonal view, same principle parts listed, plus a view of the Weight Bar Receiver (28) and Weight Bar (30). Weight Bar is a detachable metal rod that once placed into Weight Bar Receiver, and serves to hold weight plates.

Figure 4:
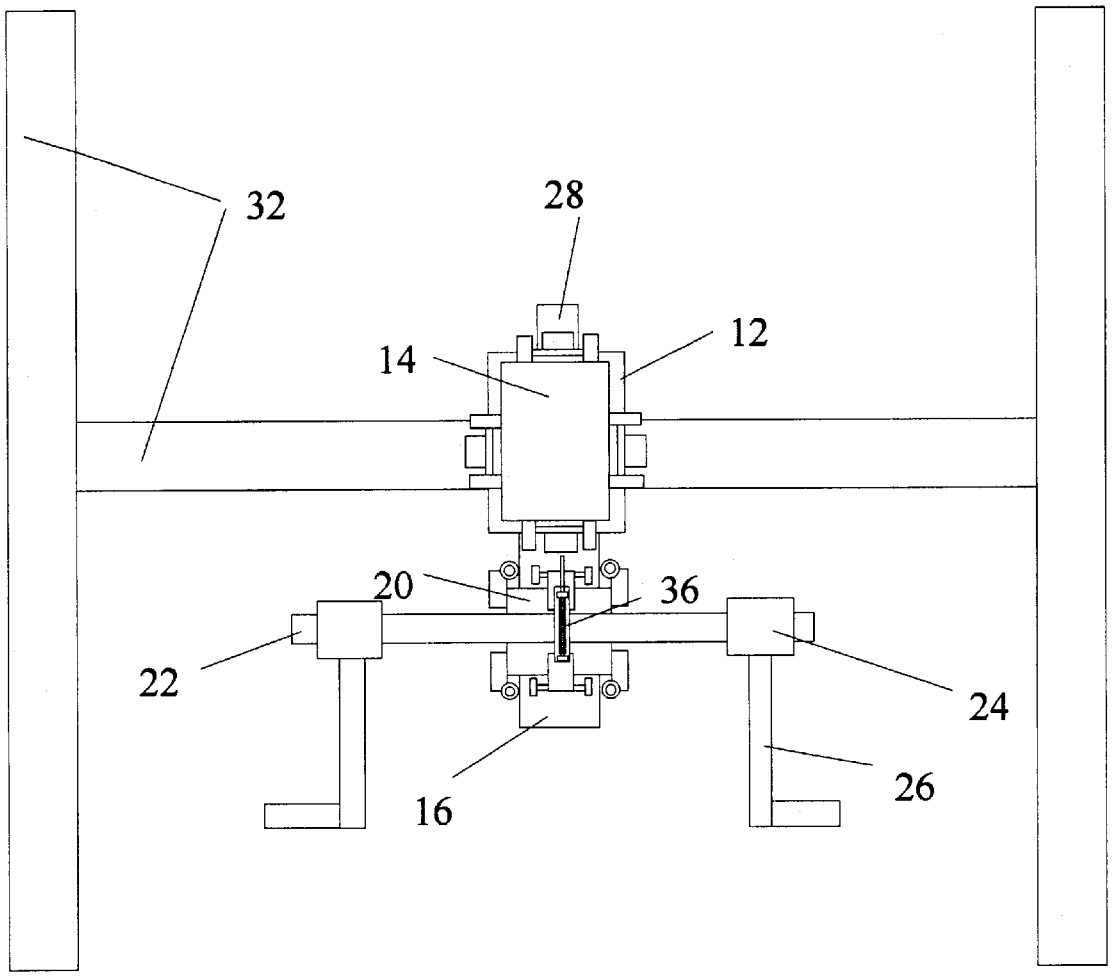
FIG. 4 is an orthogonal view of the top of the machine.

FIG. 4 shows the invention from top, orthogonal view.

Figure 5:
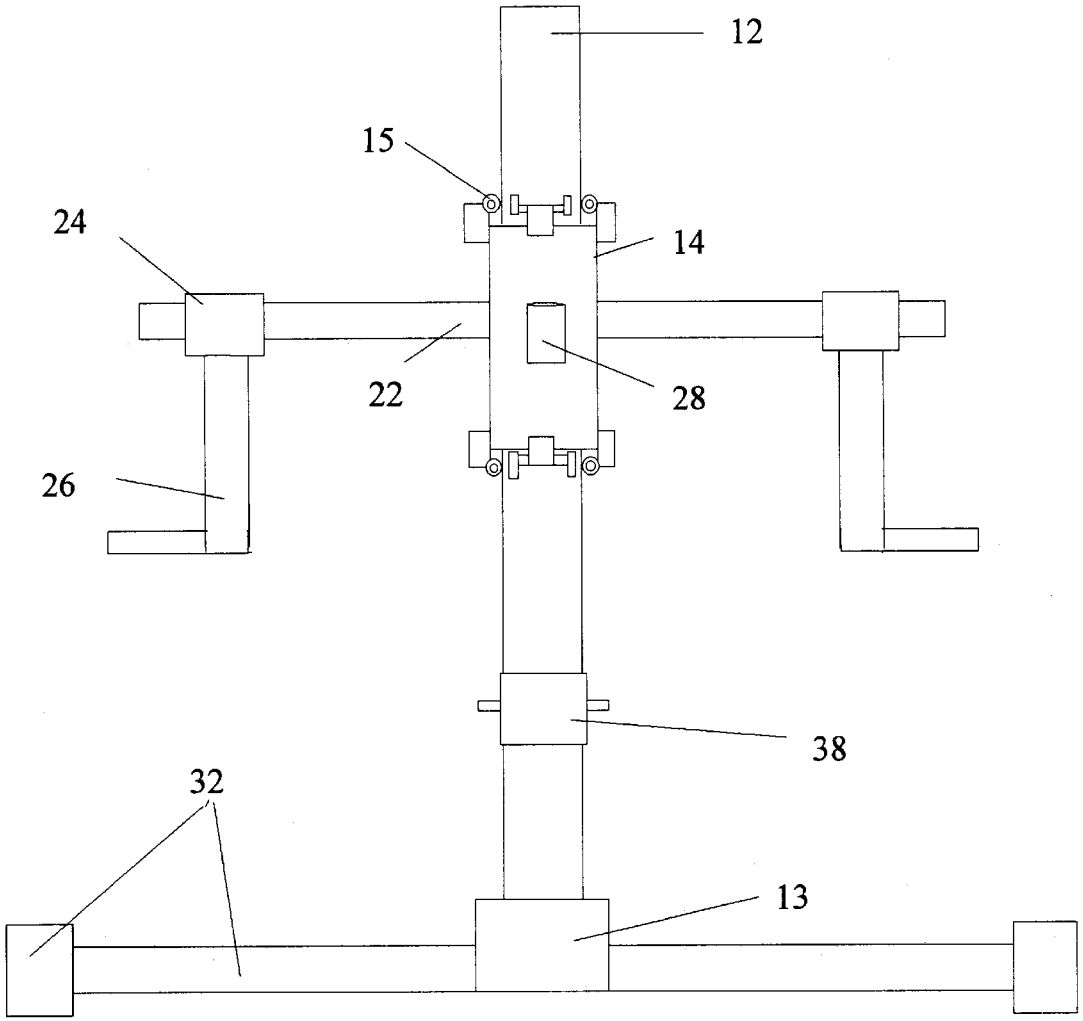
FIG. 5 is an orthogonal view of the back of the machine.

FIG. 5 shows invention from back, orthogonal view.

Figure 6:
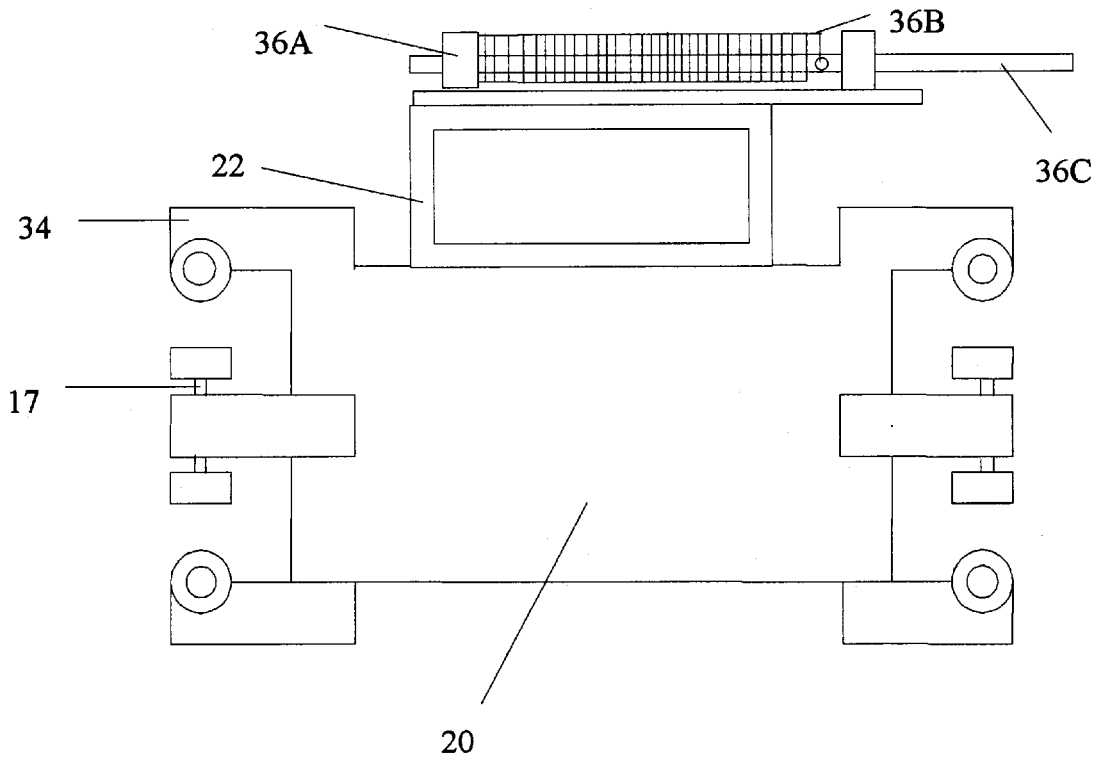
FIG. 6 is an orthogonal close-up side view of a component of the machine.

FIG. 6 shows close-up Handlebar Bearing Sleeve (20), and attached parts, side orthogonal view.

Figure 7:
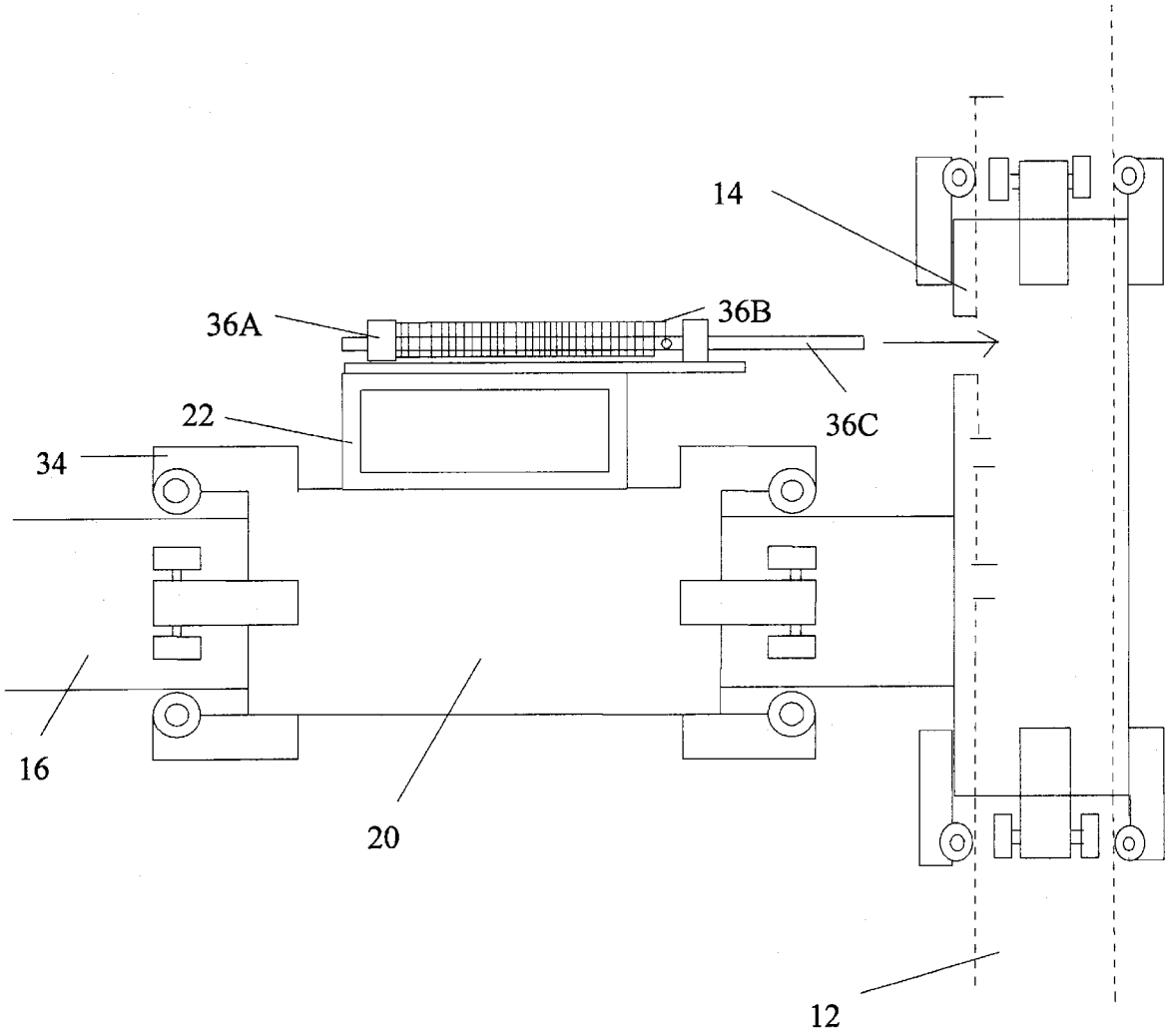
FIG. 7 is an orthogonal, close-up side view of two components of the machine.

FIG. 7 a side orthogonal view, showing Handlebar Bearing Sleeve (20) on Main Bearing Sleeve Shaft (16), which is attached to Main Bearing Sleeve (14). Spring-Loaded Catch (36) is attached to Handlebar Support Shaft (22), and consists of Lock Rod Sleeve (36A) Lock Rod Spring (36B), and Lock Rod (36C). Arrow indicates direction of motion to engage locking function.

Figure 8:
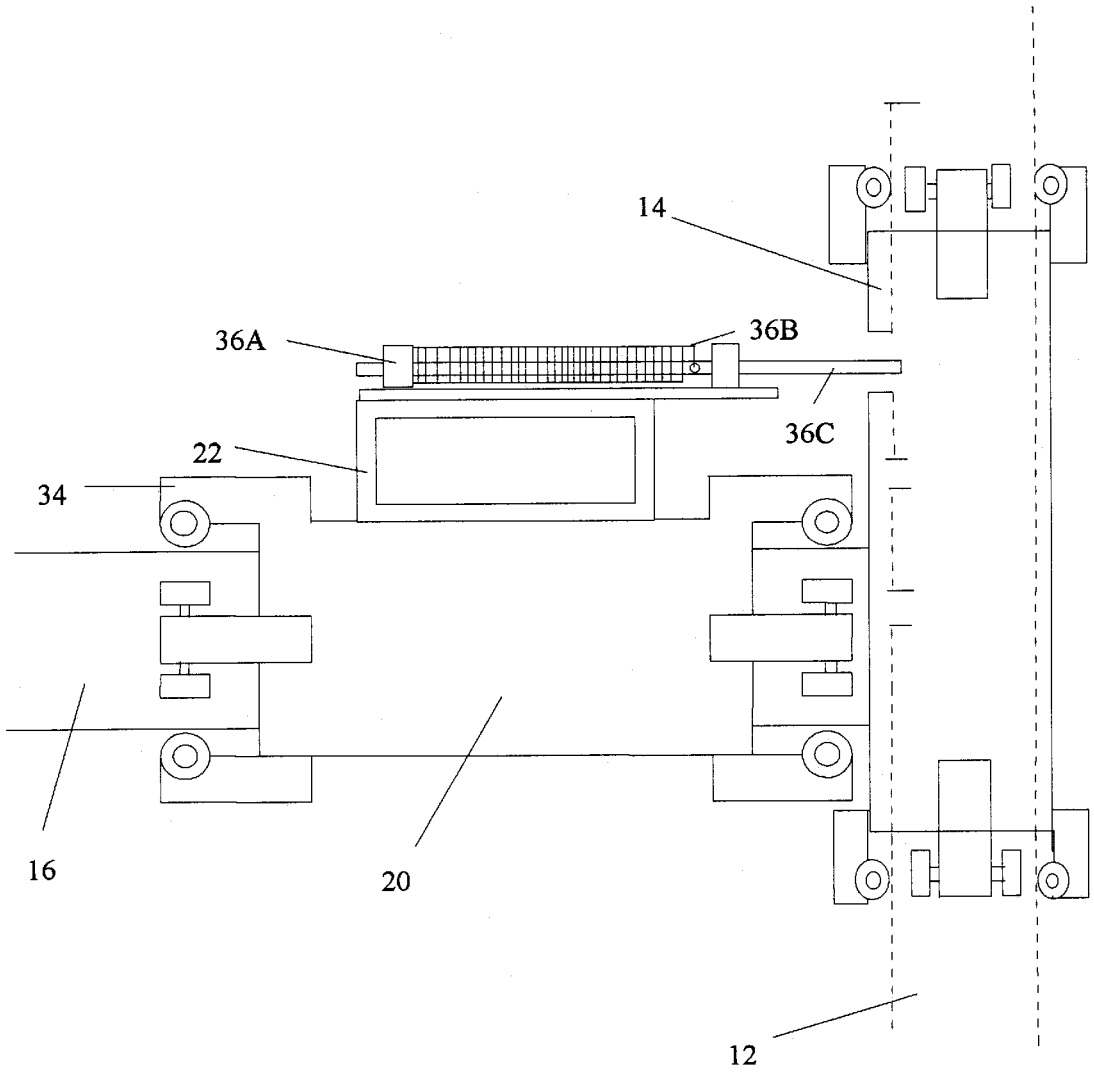
FIG. 8 is an orthogonal, close-up side view of the two components portrayed in FIG. 7, but in a different position.

FIG. 8 shows same side orthogonal view and parts, but now in locked position, with Lock Rod placed through Main Bearing Sleeve into Main Shaft.

Figure 9:
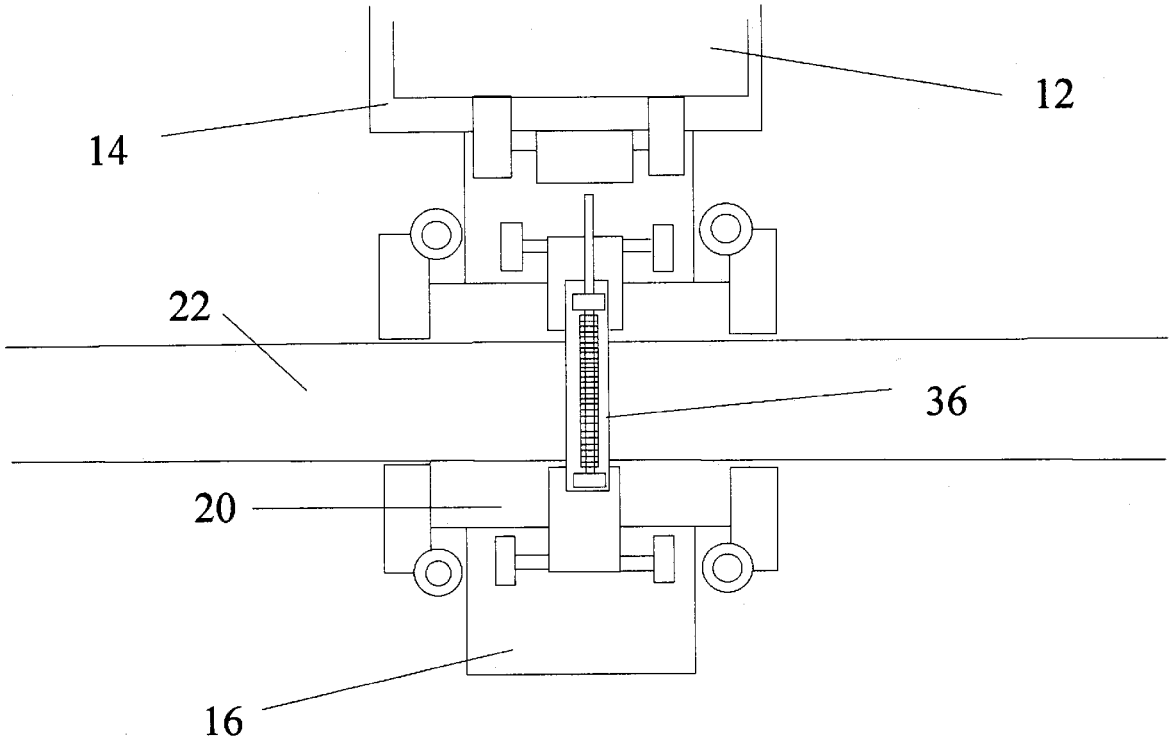
FIG. 9 is an orthogonal, close-up top view of another component of the machine.

FIG. 9 shows close-up top view of Handlebar Bearing Sleeve (20), Main Bearing Sleeve Shaft (16), Spring-Loaded Catch (36), Handlebar Support Shaft (22), Main Bearing Sleeve (14), and Main Shaft (12).

Figure 10:
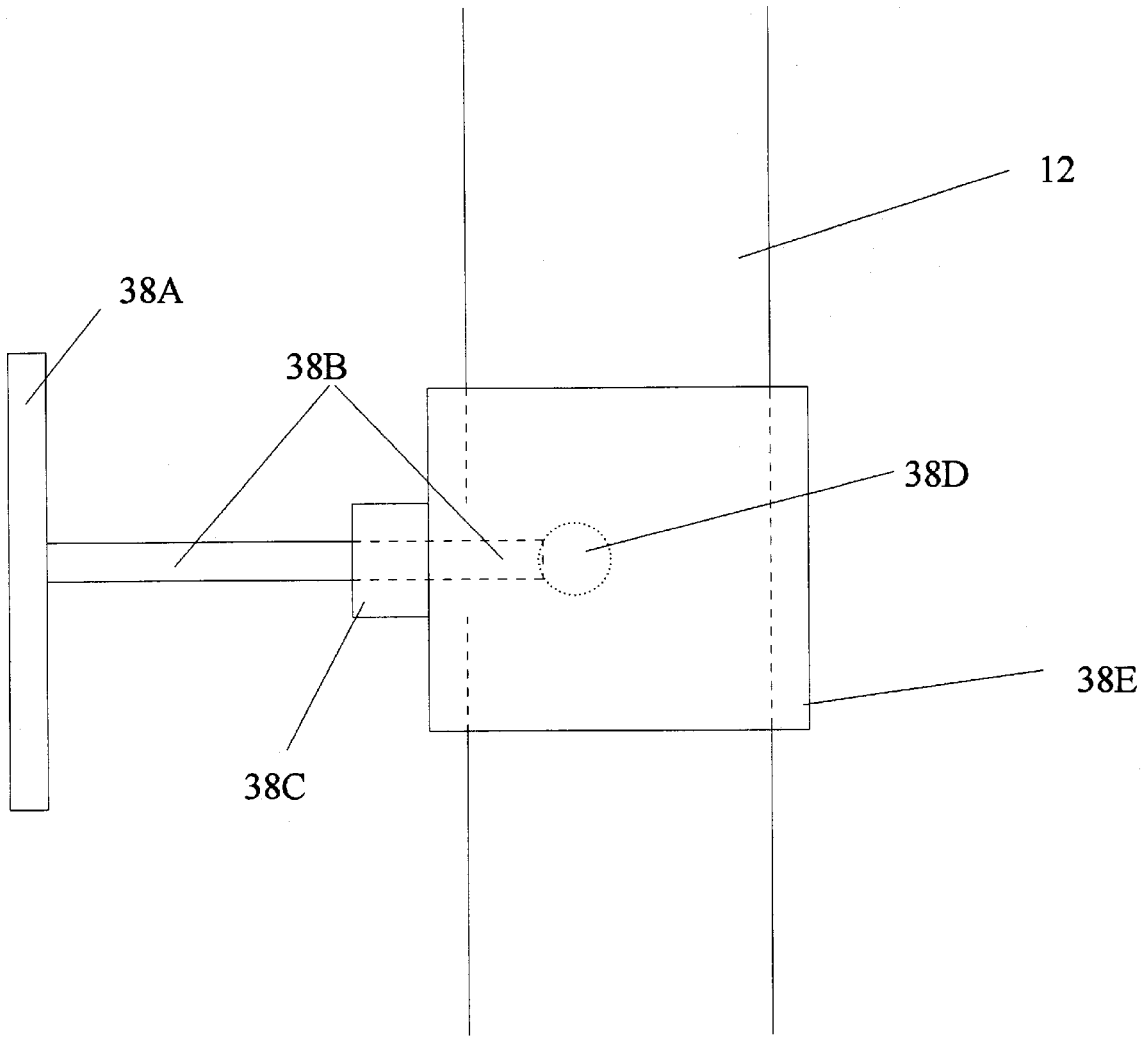
FIG. 10 is an orthogonal, close-up side view of another machine component.

FIG. 10 shows Safety Catch (38) in close-up, side orthogonal view, consisting of: Safety Catch Handle (38A), Safety Catch Rod (38B), Safety Catch Securing Nut (38C), Safety Catch Rod Stop (38D), and Safety Catch Sleeve (38E). The handle is pushed in, locking the steel sleeve. The Safety Catch Rod Stop consists of a small steel ball larger than the diameter of the Safety Catch Securing Nut, thus preventing Safety Catch Rod from being inadvertently withdrawn when being pulled out to adjust Safety Catch position on Main Shaft.

BEST MODE FOR CARRYING OUT INVENTION

Our preferred embodiment utilizes shafts of square-tube steel joined together to form a base, a main shaft, and other attachments (steel tubing may also be used for handlebars, etc.). Sliding apparatus consists of telescoping steel square tube employing ball bearings for easy movement.

OPERATION OF INVENTION (Best Mode)

Many original features of the invention flow from the Main Bearing Sleeve and the Handlebars Bearing Sleeve. The Main Bearing Sleeve slides up and down the Main Shaft. The Handlebars Bearing Sleeve slides perpendicular to the Main Shaft on the Main Bearing Sleeve Shaft. (SEE FIGS. 7 & 8).

This arrangement permits simultaneous vertical and horizontal motion.

To achieve a clear overview of how these components operate within the overall structure of the machine, a description of all movements and adjustments prior to, during, and after a standard bench press lift follow (these steps apply to all basic lifts performed on machine):

1: User adjusts Safety Catch (36) so that it stops downward motion of Main Bearing Sleeve (14) to correspond to lowest point in lift. This prevents the Handlebars from dropping below the user's comfortable range of motion.

2: User adjusts Support Shaft Sleeves (24) on Handlebars Support Shaft (22) to bring Handlebars to desired width of grip.

3: User sets Main Bearing Sleeve (14)and attached Handlebars to desired height to commence lift.

4: User places desired amount of weight on Weight Bar (30). Weight supporting rods can also be placed in Handlebars (26) for additional weight.

5: User lifts straight up, freeing Lock Rod (36C). (In the rest position, the Spring-Loaded Catch rod is placed through hole in Main Bearing Sleeve into hole in Main Shaft, locking motion between the two. The hole in Main Shaft is sufficiently large to permit play for the Spring-Loaded Catch rod. Thus, the user can lift the weight a fraction of an inch. This frees the Spring-Loaded Catch rod, allowing the user to become comfortable with weight before the rod is withdrawn along with outward motion of Handlebars).

With the Spring-Loaded Catch's Lock Rod free, the next step is to slide the Handlebars (and attached Handlebars Bearing Sleeve) away from Main Shaft, in a motion very much like weight-lifters employ in taking a barbell off a standard weight stand cradle.

6: User is now free to complete as many repetitions as he or she is able. Depending on the lift and technique, the Handlebars Bearing Sleeve (20) may move to accommodate natural elliptical motion of arms.

7: When muscle failure sets in, the user can lock the Main Bearing Sleeve in any of the holes furnished in the Main Shaft. This is accomplished by the reverse of (4): pushing the handlebars back until the Lock Rod pushes through hole in Main Bearing Sleeve and into a hole in Main Shaft.

The above is a description of the invention's operation in a simple, familiar lift. Many other exercises are possible, including military press, squat, dead lift, dips, etc. Pipe Handlebars permit more flexibility by admitting a variety of attachments (for example, a bar is slid through Handlebars for squats).

In addition, in this embodiment, the Handlebars Bearing Sleeve can be easily removed and used in a variety of exercises separate from the Weight Bar Assembly. For example, placed on a section of tubing set at a 45 degree angle, the user can perform variations of bent-over rows and leg presses, and can simulate many cable and curling motions.

Bearing Sleeves and Spring-Loaded Catch

Since these are the only semi-complex components, a more detailed description of each is in order.

As stated above, the Spring-Loaded Catch (36) consists of Lock Rod Sleeves (36A), Lock Rod Spring (36B), and Lock Rod (36C). (SEE FIGS. 6–9). The Lock Rod Sleeves are attached to top of Handlebar Support Shaft (22). The Lock Rod slides through sleeves (which may consist of pipe or nuts), projecting far enough beyond Handlebar Bearing Sleeve to extend through drilled hole in Main Bearing Sleeve into one of the holes drilled into the Main Shaft.

One end of a spring is attached to end of the Lock Rod closest to the Main Bearing Sleeve. As Lock Rod is pushed through hole in Main Bearing Sleeve, the Lock Rod Spring contracts, maintaining positive pressure on the Main Shaft, forcing the Lock Rod into Main Shaft when a hole is encountered.

In our embodiment, the Bearing Sleeves (basic construction on both is identical) consist of a section of square tubing with bearings attached. There are a multitude of ways to attach bearings, but in pictured embodiment, a steel rod with threaded ends of matching diameter is slid through the bearings. The rod is then secured to Bearing Flange (a section of flat steel), which is in turn attached to the Bearing Sleeves. The bearings are then secured to threaded rod with conventional nuts.

In anticipation of our main claims, we do not wish to specify a single, ultimate method of attaching these bearings.

Though the above contains many specific examples, we use these merely to provide illustrations of some of the preferred embodiments of our invention. We do not mean to limit the scope of the invention thereby. For example, instead of square tubing, guide rods or rectangular tubing could be employed. Instead of sections of tubular steel with bearings attached (bearing sleeves), carriages with linear bearings could be used. Rolling devices other than ring bearings could be employed, such as wheels, linear bearings, rollers, etc.

We claim:

1. An exercise machine comprising one or more vertically disposed guide elements, a vertical sleeve with sliding means for vertical travel on said guide elements, a weight securing means attached to said vertical sleeve, a horizontal receiver attached to said vertical sleeve, a horizontal sleeve with sliding means for horizontal travel on said receiver, a locking means attached to said horizontal sleeve for engaging said vertically disposed guide elements to prevent movement of said vertical sleeve therealong, and a handlebar attached to said horizontal sleeve.

2. The exercise machine defined in claim 1 wherein said vertically disposed guide elements consist of tubular steel with a plurality of centrally disposed apertures.

3. The exercise machine defined in claim 1 wherein said vertical and said horizontal sleeves consist of sections of tubular steel.

4. The exercise machine defined in claim 1 wherein said sliding means for said vertical and said horizontal sleeves consists of attached bearings.

5. The exercise machine defined in claim 1 wherein said receiver consists of tubular steel.

6. The exercise machine defined in claim 1 wherein said locking means consists of a cylinder, a rod fitting within said cylinder, and a spring attached to said rod and said cylinder, wherein said rod is forced by said spring to slide through a vertical sleeve aperture into centrally disposed apertures in said vertical guide elements.

7. The exercise machine defined in claim 1 wherein said handlebar consists of two bars attached to separate, slidably adjustable sleeves attached to said horizontal sleeve.

8. An exercise machine comprising one or more vertically disposed guide elements, a vertical sleeve with sliding means for vertical travel on said vertically disposed guide elements, a horizontal sleeve with sliding means attached to said vertical sleeve for perpendicular motion with respect to said vertical sleeve, permitting simultaneous vertical and horizontal motion of a hand grip attached to said horizontal sleeve, and a locking means securing said horizontal sleeve to said vertically disposed guide elements through apertures in said vertically disposed guide elements to prevent movement of said vertical sleeve therealong.

9. An exercise apparatus comprising a first guide element, a first traveler with sliding means for travel along said first guide element, a weight securing means attached to said first traveler, a second guide element attached to said first traveler and running transverse said first guide element, a second traveler with sliding means for travel along said second guide element, a locking means attached to said second traveler for engaging said first guide element to prevent movement of said first traveler therealong, and a handlebar attached to said second traveler.

* * * * *